United States Patent [19]

Smith

[11] 3,953,156

[45] Apr. 27, 1976

[54] ROTARY ENGINE

[76] Inventor: Thomas A. Smith, Rte. 2, Purvis, Miss. 39475

[22] Filed: Sept. 25, 1974

[21] Appl. No.: 509,157

[52] U.S. Cl. ..... 418/35

[51] Int. Cl.[2] ..... F04C 1/00

[58] Field of Search ..... 418/33, 35, 37, 38; 123/8.47

[56] References Cited

UNITED STATES PATENTS

| | | | |
|---|---|---|---|
| 2,096,074 | 10/1937 | Stevens | 418/37 X |
| 2,899,944 | 8/1959 | Patkau | 123/8.47 |
| 3,397,680 | 8/1968 | Guin | 123/8.47 |
| 3,550,563 | 12/1970 | Smith | 123/8.07 |

*Primary Examiner*—C. J. Husar
*Assistant Examiner*—Leonard Smith
*Attorney, Agent, or Firm*—James B. Lake, Jr.

[57] ABSTRACT

A rotary engine having an annular cylinder with more than one piston drivable in rotation therein, the pistons being fixed respectively to concentric hollow shafts that are thereby independently rotated thereby around their concentric axis. Crank members, at least one per piston, are mounted in ball races that are eccentrically fixed to the respective concentric shafts, the crank members extending diametrically across their respective concentric shafts. An eccentric drive shaft displaced radially from the axis of the concentric shafts mounted for rotation in and extending through said concentric shafts, the eccentric shaft defining diametric holes for slidably engaging the crank members without loss of rotational motion while allowing the crank members to move simultaneously toward the away respectively from the eccentric shaft axis at constantly varying speeds and directions to thereby rotate the eccentric shaft. Both eccentric and concentric shafts are mountable in ball races fixed in a motor housing and the ends of concentric shafts for support of all shafts at their respective ends. As many as four pistons can be mounted in each cylinder respectively fixed to a concentric shaft and collars sleeved for independent rotation on said shaft, and additional cylinders can be added to extension of an end of the eccentric shaft.

5 Claims, 6 Drawing Figures

ROTARY ENGINE

BACKGROUND OF THE INVENTION

1. Field Of The Invention

The invention relates to rotary engines and more particularly to rotary engines having one or more annular cylinders each having two or more pistons.

2. Description Of The Prior Art

The closest art is my U.S. Pat. No. 3,550,563. The present invention is an improvement thereon. The references cited during the prosecution of the application of said patent being the remainder of the art known to me.

SUMMARY OF THE INVENTION

The invention is an improvement in a rotary engine having an annular or toroidal cylinder in that the means and positioning thereof for transferring the rotation of concentric and eccentric shafts from one to the other is centered between supports of the eccentric shaft which is extended through the engine for the easy addition of elements thereto and for the addition of pistons in the cylinder thereof.

It is an object of the invention to provide a rotary engine having an annular cylinder, that is better dynamically balanced.

Another object of the invention is to provide ball raceway support for both ends of the eccentric shaft.

A further object of the invention is to provide for the better mounting of additional pistons in a cylinder.

Still another object of the invention is to provide for the easy addition of other elements to the engine.

DESCRIPTION OF THE PREFERRED EMBODIMENTS

Figure 1:
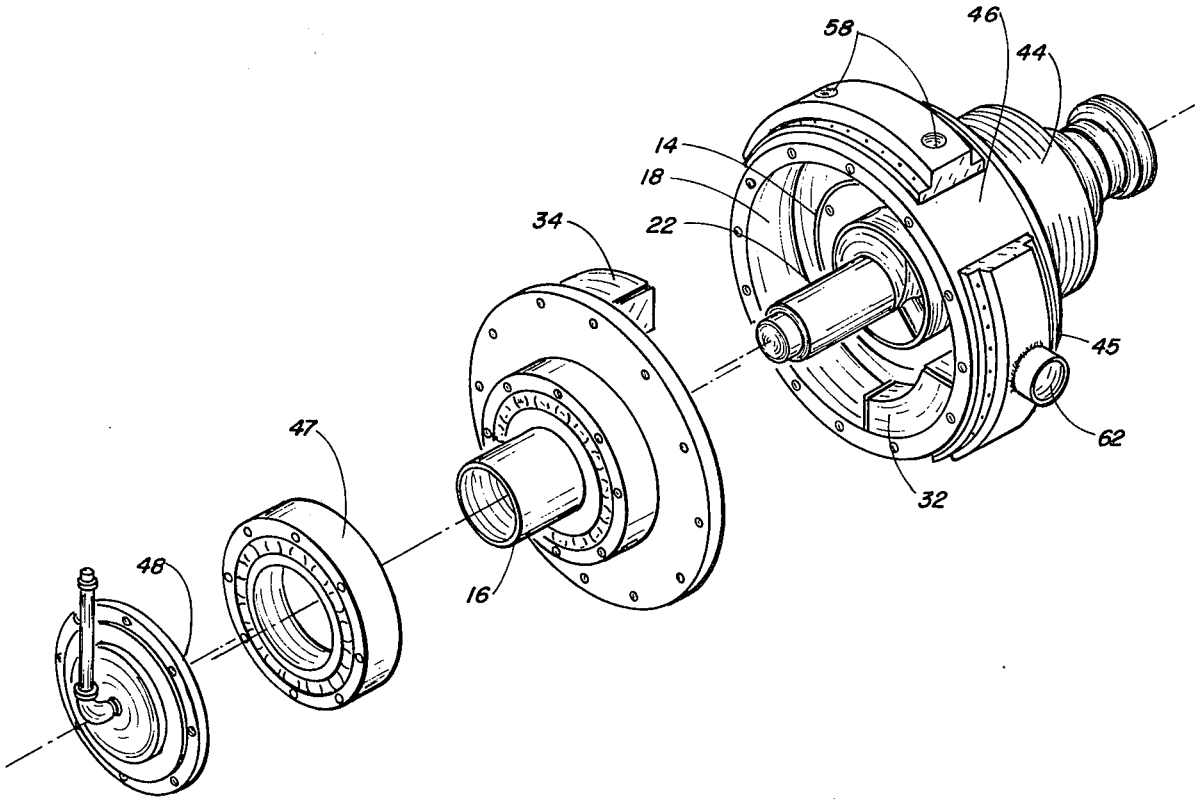
FIG. 1 is an exploded three-dimensional view of an improved rotary engine.
Figure 2:
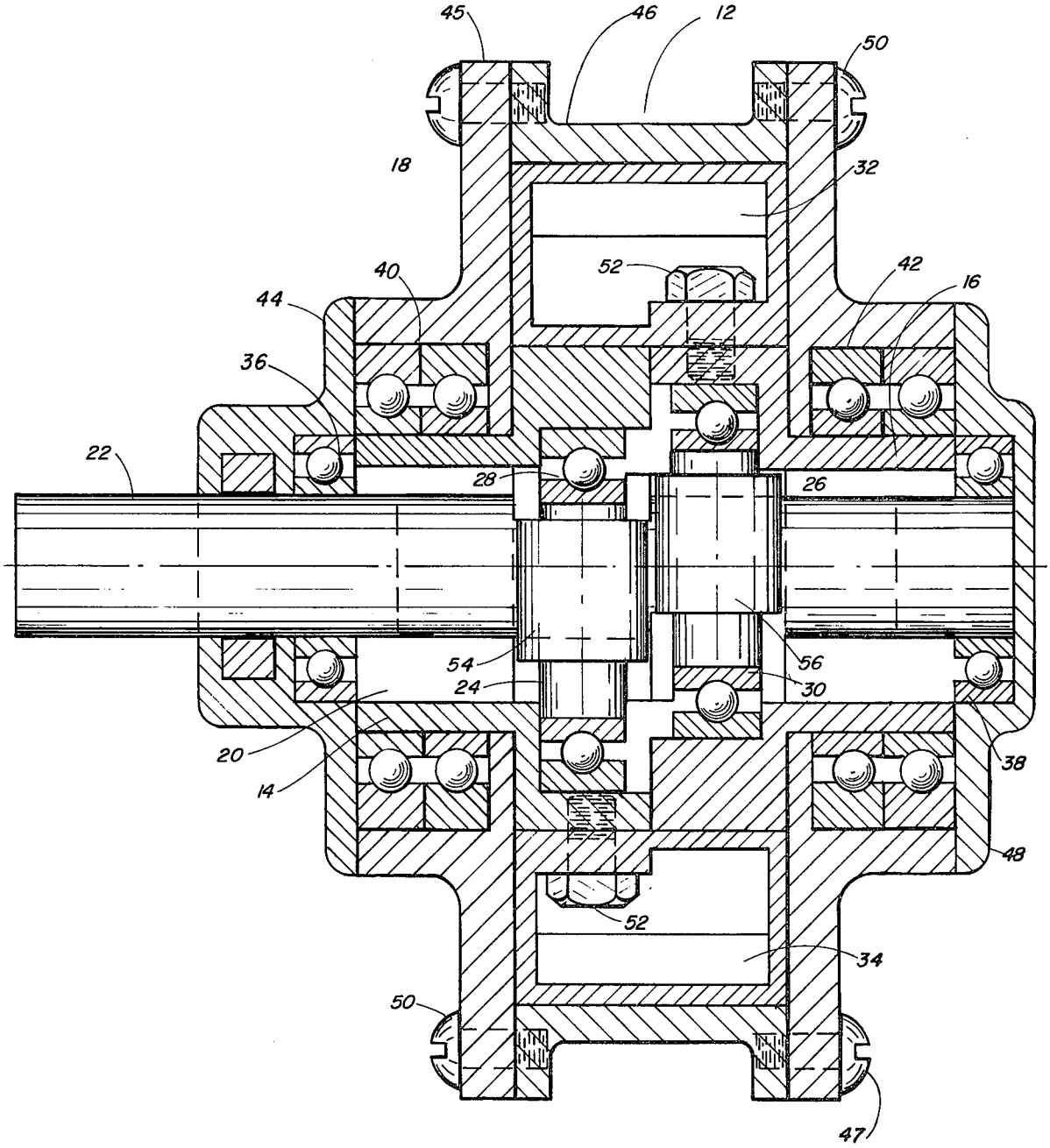
FIG. 2 is a side view, partially sectioned of the engine of FIG. 1.

Referring to FIGS. 103, the invention 10 comprises a composite housing 12 defining in cooperatin with concentric shafts 14 and 16 mounted for indepedent rotation therein, a circumferential annular cylinder 18 and an axial space 20 in which are mounted for rotation an eccentric shaft 22 and transverse members 24 and 26 connecting through eccentric raceways 28 and 30 concentric shafts 14 and 16 to eccentric shaft 22 for the rotation of each other. Pistons 32 and 34 are mounted in annular cylinder 18 for rotation therein and are respectively fixed to concentric shafts 14 and 16 for independent rotation therewith. Eccentric shaft 22 is supported by ball races 36 and 38 respectively outboard of transverse members 24 and 26, and concentric shafts are supported by double ball raceways 40 and 42 at their respective outboard ends.

More particularly, composite housing 12 comprises housing elements 44—48 that when bolted together with bolts 50 define a plurality of axially contiguous cylindrical spaces. The two concentric shafts are aligned end to end with their respective opposite ends supported for aligned rotation in double ball races 40 and 42, and together define with the housing elements the annular circumferential cylinder 18. Pistons 32 and 34 are fixed to respective concentric shafts by bolts 52. Eccentric shaft 22 defines two transverse holes in its mid-part in which sleeves 54 and 56 are respectively fixed and oppositely offset radially. Transverse crank members 24 and 26 are adapted to slidably engage respectively in said sleeves with no loss motion therebetween, and their ends are fixed to the inner raceways respectively of ball raceways 28 and 30 which have their respective outer raceways eccentrically fixed to their respective concentric shafts 14 and 16.

Figure 3:
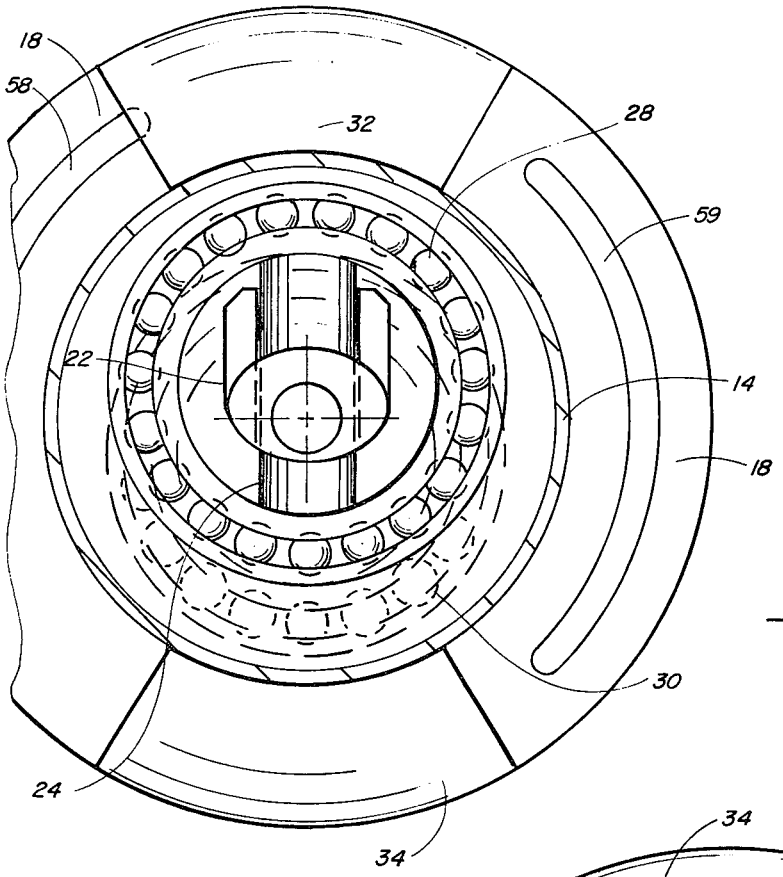
FIG. 3 is a cross-sectional view taken along section line 3—3 of FIG. 2, with the eccentric shaft at 180° from D.C.
Figure 4:
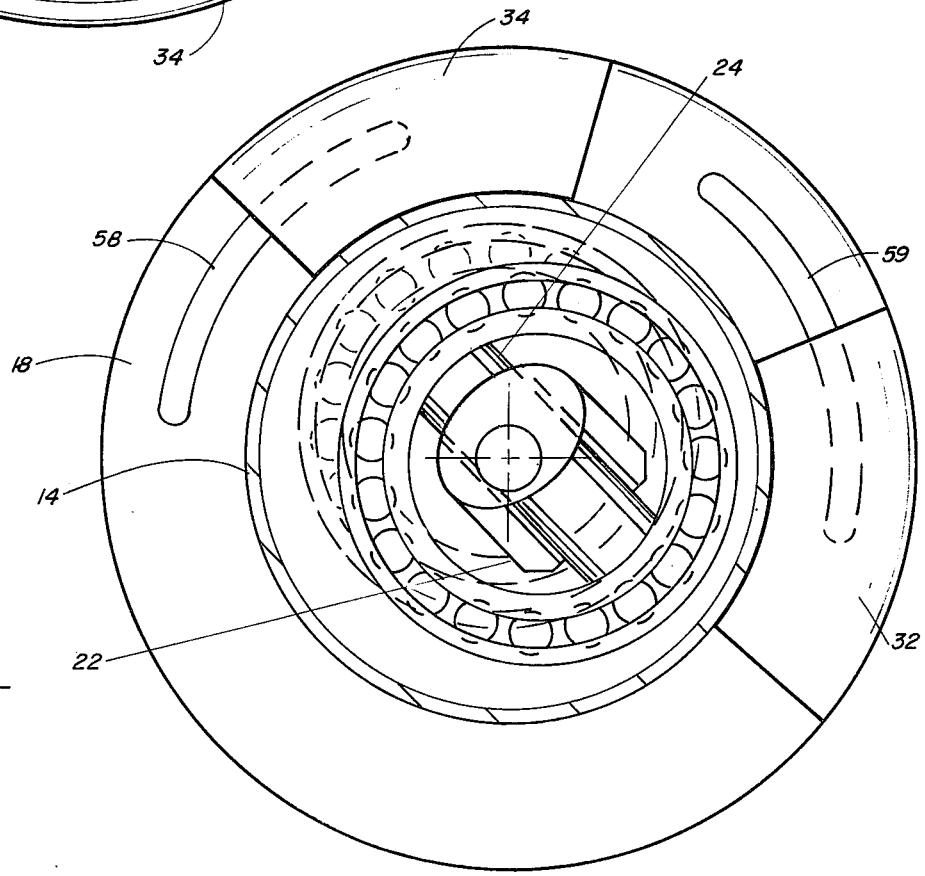
FIG. 4 is similar to FIG. 3 with the eccentric shaft rotated about 135° from the position of FIG. 3.

In operation steam pressure is admitted to annular cylinder 18 through port 58 (see FIG. 1) and drive pistons 32 and 34 therearound, the steam being exhausted through port 59 (see FIG. 3) and not the same. Concentric shafts 14 and 16 being respectively fixed to pistons 32 and 34 are independently rotated thereby with the outer races of ball races 28 and 30 respectively fixed thereto. Crank members 24 and 26 being respectively fixed to the inner races of ball races 28 and 30 slide in sleeves 54 and 56 respectively toward and away, alternately and oppositely, from the axis of eccentric shaft 22 to rotate said eccentric shaft by the crank action of the difference between the respective distances from said axis of the eccentric shaft to the eccentric ball races 28 and 30 as shown by line 60 of FIGS. 3 and 4. In one revolution of the eccentric shaft, the concentric shafts, together travel one revolution, pistons 32 and 34 alternating in leading between power strokes in the direction of engine rotation. The admission ports 58 and exhaust port 62 are arranged as shown in FIGS. 3 and 4 and are opened and closed by the pistons in proper sequence as they travel in the annular cylinder.

Figure 5:
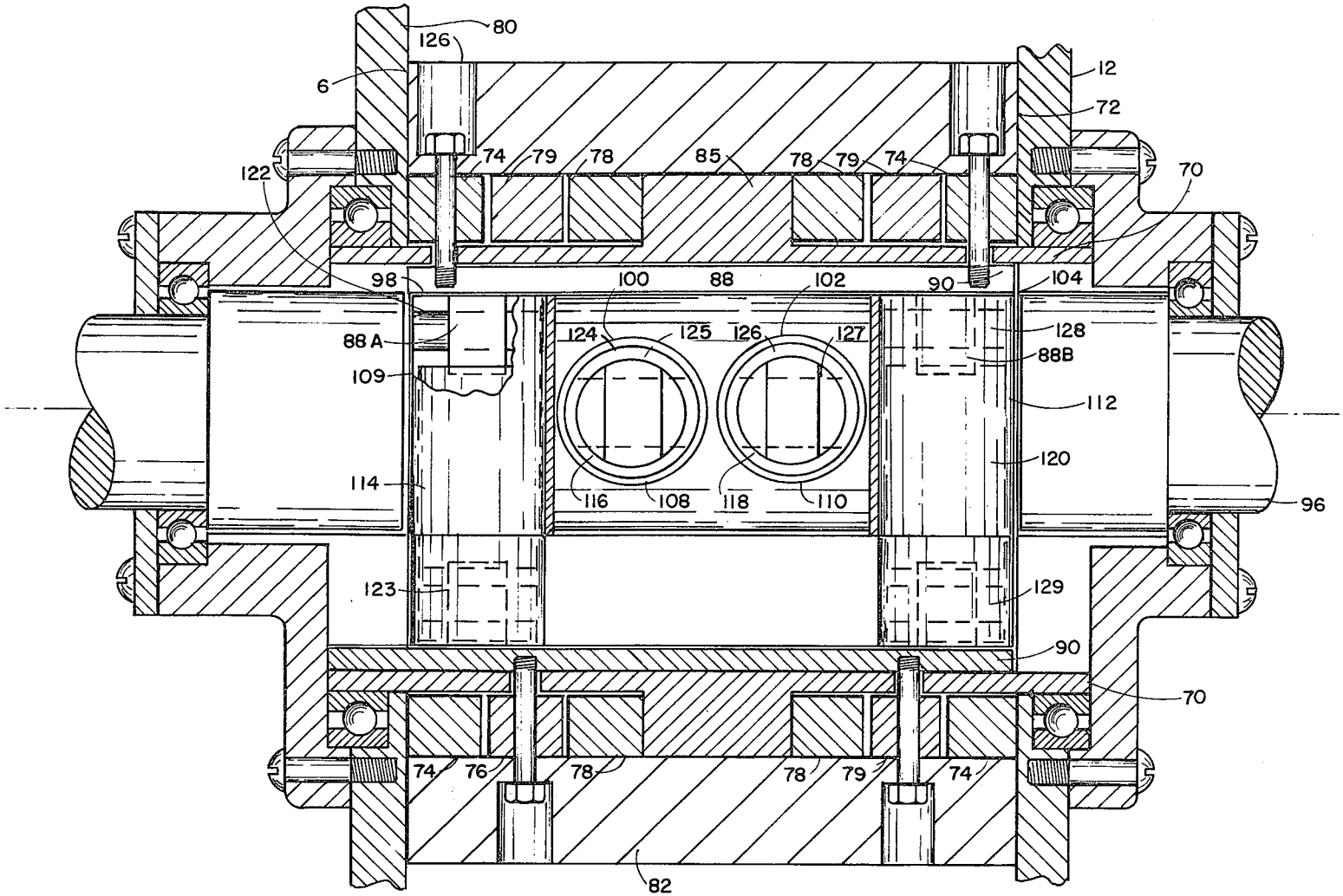
FIG. 5 is a view similar to FIG. 2 of a specie of the invention having four pistons.
Figure 6:
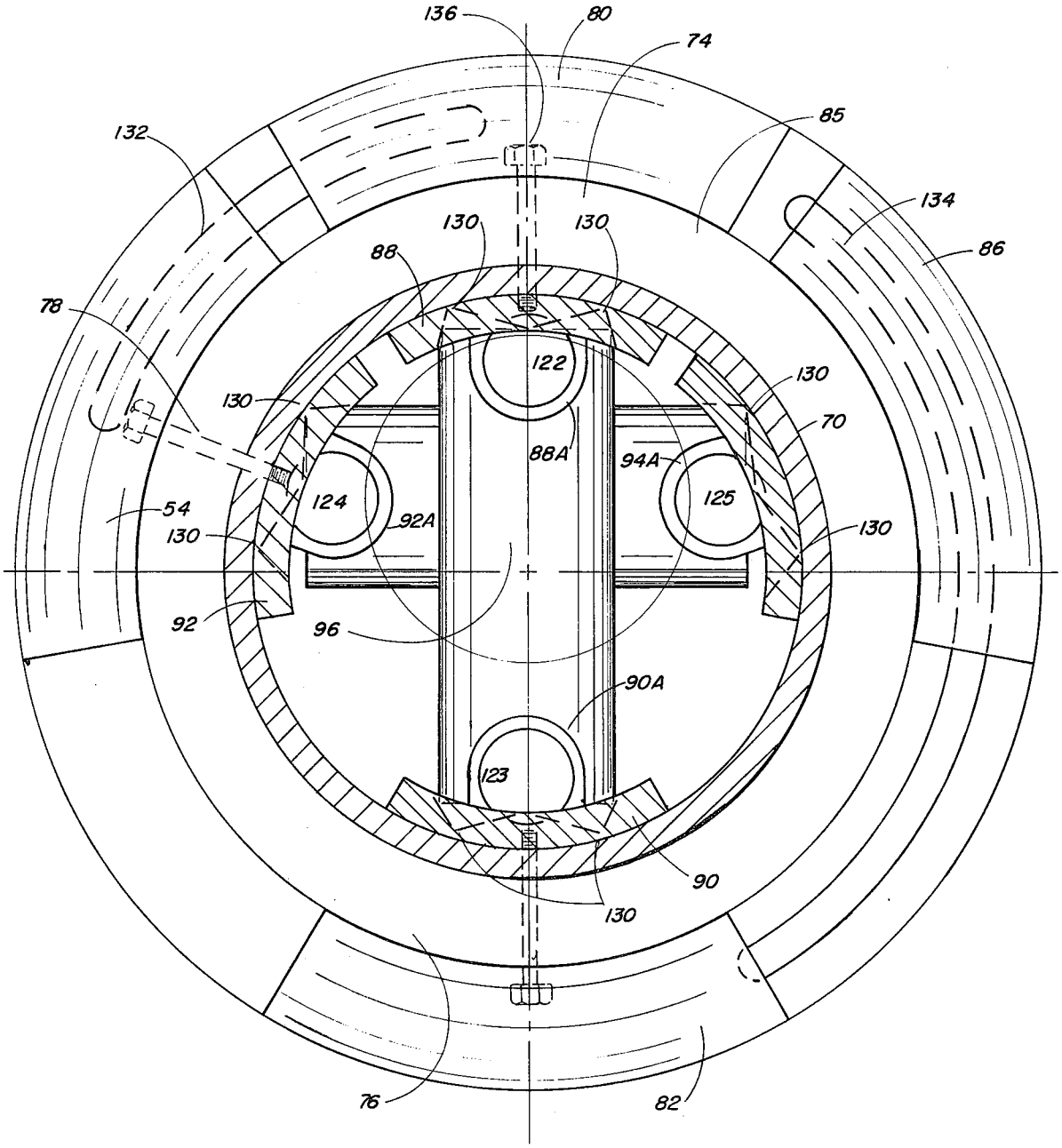
FIG. 6 is a sectional view similar to FIGS. 3 and 4 but taken along section line 6—6 of FIG. 5.

Referring to FIGS. 5 and 6 a specie of the invention having four pistons mounted in a single annular cylinder is shown with parts in common with the first specie partially indicated in dashed lines and the different parts indicated in solid lines.

Referring to FIGS. 5 and 6, the four cylinder specie comprises housing 12, a single hollow shaft 70 mounted for rotation therein and defining in combination therewith a circumferential annular cylinder 72. Three pairs of collars 74, 76, and 78 are mounted for independent rotation on shaft 70, the collars of each pair being axially spaced apart by respectively equal distances from the midpoint of shaft 70. Each pair of collars is fixed to respective pistons 80, 82, and 84. A fourth piston 86 is directly fixed to a center section 85 of shaft 70. The pairs of collars 74, 76, and 78 are respectively fixed to associated bars 88, 90, and 92 through slots 70 which itself is fixed to a similar bar 94.

An eccentric shaft 96, having its longitudinal axis spaced radially from the longitudinal axis of shaft 70, is mounted in housing 12 and extends through hollow shaft 70. Four diametrical holes 98, 100, 102, and 104 are defined sequentially in a center section of eccentric shaft 96. Holes 98 and 104 are parallel and spaced apart by holes 100 and 102 which are also parallel and spaced apart by holes 100 and 102 which are also parallel but normal to the plane of the other two. Four transverse members 106, 110, and 112 are adapted to slidably engage in respective holes 98–104, said members are hollow and have one engageable end each. A second set of four transverse members 114, 116, 118, and 120 are adapted to slidably engage respectively in hollow transver members 106–112 and have engageable ends which are oppositely disposed from those of said hollow transverse members. Each of bars 88–94 have two parallel projections that extend normal thereto and are spaced axially apart to engage the engageable ends of two of said transverse members. The projections will be designated by the associated bar numeral with subscripts *a* and *b*. Projections of each bar should engage parallel transverse members of the same set, no particular order is especially desirable. Pins 122–129 (FIGS. 5 and 6) respectively engage the engageable ends of the eight transverse members to associated projections *a* and *b* of pairs of collars 88–94. The interior surfaces of said collars define indentations 130 as shown in FIG. 6 to accommodate the nagled ends of the respective transverse members.

In operation, the four piston engine performs similarly to the two piston specie, but with smaller strokes. Steam is admitted to import port 132 and exhausted from exhaust port 134. There is no dead center applicable to all pistons at the same time, each pair of pistons having one while the other pair is at a maximum torque. For example, the available torque for turning eccentric shaft 96 is the difference between the distance between a center defined by the centerline of shaft 96 and transverse member 106 to center of pin 123 less the distance from said center to center of pin 122 a maximum for this pair of pistons 80 and 82. For pistons 84 and 86, the line passing through the center of pins 124 and 125 is bisected by the center of the eccentric shaft and are at effective dead center with no torque exerted by them.

The sleeving of the pairs of transverse members not only halves the axial distance required in the engine but also reduces wear on the bearings of the concentric and eccentric shafts by eliminating axial distance between the transverse members of a sleeved pair that produced a twist causing the bearings to wear at the top of the shafts on one side of the transverse members and at the bottom of the shafts on the other.

The combination of the sleeved transverse members and the projections *a* and *b* of the respective collars and shaft 70 also provides for a sliding action between each sleeved pair of transverse members, increasing and shortening the lengths the combined lengths as they rotate to thereby eliminate the necessity of an additional ball race eccentrically mounted.

FIG. 6 for ease of illustration shows the connection of piston to collar to bar by means of the same bolt 136, the connections will generally be by two bolts 180° apart for better balance of the engine in operation.

While the engine has been described for use with steam both can also be operated as a Stirling type heat engine as described for the rotary engine of my previous U.S. Pat. No. 3,550,563. and as a pump.

By extending the eccentric drive shafts through the engines, any number can be assembled to form an engine of any desired number of cylinders. An end plate of housing 12 is removed and the abutting ends of the eccentric drive shafts keyed or sleeved together. Also a continuous eccentric shaft may be utilized.

While admission and exhaust ports 58 and 59 respectively may be continuous as shown in FIGS. 3 and 4, when manifolded as illustrated in FIG. 1 there can be a number of discrete ports for discontinuous admittance and exhaust in any part or parts of the admission and exhaust cycles.

What is claimed is:

1. A rotary engine having an annular cylinder, hollow shafts supported for independent rotation concentric with said cylinder, and at least two pistons adapted to rotate within said cylinder, each said piston fixed to a respective shaft, said engine comprising:

a. An eccentric drive shaft mounted in said engine and passing through said concentric hollow shafts, said eccentric shaft having oppositely disposed ends extending beyond the ends of said concentric shafts and supported for rotation around its eccentric axis by its ends outboard of the concentric shafts' ends, and defining diametrically parallel holes that are oppositely offset from said eccentric axis and intermediate the rotational supports of both eccentric and concentric shafts;

b. Transverse members, having oppositely disposed ends, slidably mounted, respectively, in said parallel holes; and c. Bearing means eccentrically fixed to and between oppositely disposed ends of said transverse members and their respective concentric shafts to slidably engage said members and shafts for transmitting the rotation of pistons and concentric shafts to said eccentric drive shaft.

2. A rotary engine as described in claim 1 wherein said bearing means are ball bearings having outer raceways respectively and eccentrically fixed to said concentric shafts, and inner raceways fixed to the oppositely disposed ends of the respective transverse members.

3. A rotary engine as described in claim 1 wherein said concentric shafts are sequentially aligned and supported at their outer ends by ball bearings.

4. A rotary engine having an annular cylinder and a plurality of pistons rotable in a sequence of power strokes in said cylinder, and comprising:

a. A hollow shaft supported for rotation in said engine concentric with said annular cylinder, said hollow shaft defining the same plurality of pairs of circumferential slots, less one as said plurality of said pistons, said pairs of circumferential slots extending for the length of a power stroke and axially spaced from the center of the shaft;

b. the same plurality of pairs of collars as said plurality of pairs of circumferential slots, said pairs of collars mounted for independent rotation on said concentric hollow shaft, the collars of each said pair being equally and oppositely spaced axially from the center thereof to coincide with the axial spacing of said circumferential slots therein, each of said plurality, less one of said plurality, less one of said pistons being fixed to a pair of collars, and said one piston being fixed to said hollow shaft;

c. An eccentric drive shaft mounted in said engine and passing through the concentric hollow shaft and collars, said eccentric shaft having oppositely disposed ends extending beyond the ends of said hollow shaft and collars and supported by said ends for rotation around its eccentric axis, and defining the same plurality of diametrical holes as said plurality of pistons, said diametrical holes arranged parallely in pairs, the holes of a pair being spaced apart by another pair of holes that are normal to said first pair;

d. the same plurality of pairs of slidably sleeved transverse members as said plurality of diametrical holes, said slidably sleeved transverse members being adapted to slidably change its combination length and having oppositely disposed engageable ends, slidably mounted, respectively, in said diametrical holes, e. the same plurality of bars as said plurality of diametrical holes, said bars arranged in said concentric hollow shaft, each being secured to a pair of collars thru said circumferential slots, each said bar having projections adapted to engage the lugeable ends at one end of a parallel pair of transverse members and thereby rotatably connect said concentric hollow shaft and collars with said eccentric shaft, the relative slidable relationship of each of said sleeved pair of transverse members conforming the lengths thereof to the eccentricity of rotation of the shafts and collars.

5. A rotary engine as described in claim 4 wherein the respective pairs of collars are fastened to bars 180° from their fastening to respective pistons for better balancing the rotating parts.

* * * * *